United States Patent [19]

Frielinghaus

[11] Patent Number: 5,010,310

[45] Date of Patent: Apr. 23, 1991

[54] ALTERNATING CURRENT IMMUNIZED RELAY AND METHOD OF IMMUNIZING A RELAY TO ALTERNATING CURRENT

[75] Inventor: Klaus H. Frielinghaus, Rochester, N.Y.

[73] Assignee: General Signal Corporation, Stamford, Conn.

[21] Appl. No.: 208,181

[22] Filed: Jun. 16, 1988

[51] Int. Cl.[5] ..... H01F 7/10

[52] U.S. Cl. ..... 335/243; 335/245; 335/246

[58] Field of Search ..... 335/243, 244, 245, 246

[56] References Cited

U.S. PATENT DOCUMENTS

| | | | |
|---|---|---|---|
| 2,546,740 | 3/1951 | Goldberg | 335/245 |
| 4,491,816 | 1/1985 | Blum | 335/245 |
| 4,700,165 | 10/1987 | Brisson et al. | 335/245 |
| 4,806,894 | 2/1989 | Koto | 335/304 X |

OTHER PUBLICATIONS

Protected D.C. Track Relay Type Bl, Metropolitan Vickers, United Kingdom, 1959.

*Primary Examiner*—George Harris

*Attorney, Agent, or Firm*—Ronald Reichman; Robert S. Smith

[57] ABSTRACT

A relay apparatus which comprises an armature, means for pivotally mounting the armature, first and second pole pieces dimensioned, configured and disposed for cooperation with the armature, a magnetic circuit including at least one coil, a plurality of iron shunt lamina spanning the magnetic circuit intermediate at least one of the coil and the first and second pole pieces, and a plurality of copper washer slugs in the magnetic circuit intermediate at least one of the first and second pole pieces and the iron shunt lamina. The invention also includes a method of immunizing a relay from alternating current.

7 Claims, 6 Drawing Sheets

ALTERNATING CURRENT IMMUNIZED RELAY AND METHOD OF IMMUNIZING A RELAY TO ALTERNATING CURRENT

BACKGROUND OF THE INVENTION

The invention relates to railway signaling relays and particularly to relays used in railway signalling apparatus and particularly for broken rail detection systems. Such relays are widely used and a model which has particularly wide use is known as the "B" relay. Forms of that relay are described in greater detail in U.S. Pat. No. 4,564,829, and U.S. Pat. No. 2,258,122 both assigned to the same assignee as the present application. The relay description in these patents is incorporated herein by reference.

Although the invention also has particular application to bias neutral relays, it will be understood that the invention also has application to conventional neutral relays. Bias neutral relays have been around for a long time and are characterized by a magnet disposed near the pole pieces that works on the armature. The relay includes a magnetic shunt that is near the coil of the relay. The relay is "biased" in the sense that you can effectively only energize or pick the relay with the current in a single direction. In the opposite direction the current required to pick the relay may be as much as 40 times the current required in the opposite direction of current flow. A neutral relay can be picked or energized with either polarity direct current.

A broken rail detection system typically has the two rails of an axial section of track electrically isolated from the end abutting sections of track by the installation of insulating joints in each rail at two axially spaced locations. A battery is coupled to the rails at one axial location and the coil of a relay is connected to the two rails approximately five or more miles away. Any break in either rail causes the relay contacts to separate and cause a warning signal to be displayed to the engineer operating a locomotive on that section of track. The broken rail detection circuit is short circuited by the wheels of a train and thus the relay may also be released due to this effect.

For many years, circuits of this type were designed specifically for train detection and secondarily to provide broken rail detection. Currently, many railroads are adding fail safe radio detection equipment and want to remove the train detection track circuits while retaining the broken rail detection capability. It is thus desirable to optimize the circuit for just detecting broken rails even though such a system cannot consistently detect the presence of trains on a given section of track. In other words, such a system may or may not detect the presence of a train on a track system. By optimizing the system for broken rail detection, the circuit can be three to four times as long as what would be required if both reliable train and reliable broken rail detection were essential. The track circuit for just detecting broken rails can be as much as ten miles in length as opposed to a typical track circuit for detecting trains which seldom can be more than about three miles in length. Therefore, if all that is desired is to detect broken rails and not detect trains, only about ⅓ as much apparatus is required to cover the same length of track or the same amount of equipment or cover about three times as much track. Thus, the cost of the system is substantially reduced. The maximum length of track being protected is obtained if the resistances of the circuits at both the battery end of the rails and the relay end of the rails are made as low as possible.

It is common practice to position alternating current transmission lines parallel to railroad tracks because the easement for the railroad tracks often allows power lines to be located along the same right of way. Power lines may also be positioned along side the railroad tracks to power electrically powered trains as well as signalling circuits. Particularly, in foreign countries alternating current power is used to power the trains and thus those power transmission lines are particularly likely to induce alternating current currents in the rails. These lines can all contribute to inducing alternating current voltages in the tracks and this can interfere with satisfactory operation of a broken rail detection system. More specifically, induced alternating current in the rails can cause a relay to be energized at voltage and current conditions that will cause a broken rail detection system to give a false assurance of a safe operating condition. Thus, a malfunction of the broken rail detection system may create a serious risk of personal and property injury.

Traditional approaches used in the United States to avoid a problem with the induced alternating current are (1) to make the line circuits very short which means you have to use a lot more relays and equipment and/or (2) to bury a heavily shielded power transmission cable in the ground. The latter approach involves spending a lot of money to bury a special cable which could be avoided by merely using an alternating current immune relay.

The prior art includes the apparatus shown in FIGS. 1 and 2. These relays have been made in Great Britain. The apparatus of FIG. 1 includes a special airgap structure which provides an alternating current path so that very little of the alternating current flux flows through the armature and thus does not affect the operation of the relay to provide alternating current immunity. In this structure, a core C, a waist W and a pole extension PX directing alternating current to the yoke Y. A small amount of the alternating current flows through the pole P to the armature A and then to the yoke Y.

FIG. 2 illustrates a structure with a relatively heavy monolithic magnetic shunts which directs both the alternating current and the direct current. Because of the heavy copper slugs CS a high reluctance is provided to the alternating current so that essentially just the direct current flux flows through the armature A. The copper slugs CS act like an inductor or shorted turn that also provides an impedance to the alternating current flux flow. Because the copper slugs CS act as a shorted turns, some relays having this feature may unfortunately have a much higher alternating current flow through the coils C, C. The known copper washer slugs used in the prior art have been used strictly to provide longer operating times. In other words, to make the relay a slow pick up relay or a slow drop away relay.

The prior art includes relays made and sold by the assignee of the present invention which have utilized a plurality of copper slug washers for the purpose of varying the timing characteristics of the relay. Magnetic shunt lamina have not been used in the prior art to the best of the applicant's knowledge.

It is an object of the invention to provide a method for and a relay apparatus for providing a substantial immunity to induced alternating current voltages and which will thus promote safe railroad operation.

It is another object of the invention to provide an AC immune relay that does not increase the resistance of the operating coil and thus render the relay less suitable for use in a broken rail detection system.

It is another object of the invention to provide apparatus which will have adjustable alternating current immunity, adjustable sensitivity and adjustable timing characteristics and further that such adjustability can be readily varied to make a relay meet unique specifications for particular applications and which will minimize the requirements to maintain inventory.

It is yet another object of the invention to provide apparatus which will utilize substantially all of the component parts of existing production relays and thus will be inexpensive to manufacture.

It is another object of the invention to provide a relay which can have substantially the same pick up (energization) and drop away (de-energization) voltage and current characteristics as the existing relay which has not been modified.

It is an object of the invention to provide an alternating current immunized relay utilizing a magnetic structure means which does not insert additional resistance in the relay circuit and does not require external components for the relay.

It is a further object of the invention to provide apparatus which, at least in some embodiments, will have less sensitivity than conventional relays and thus will be less vulnerable to noise pulses.

A further object of the invention is to provide a more efficient shunt path for alternating current than has been provided by monolithic magnetic shunts in the past.

SUMMARY OF THE INVENTION

It has now been found that these and other objects of the invention may be attained in a relay apparatus which comprises an armature, means for pivotally mounting the armature, first and second pole pieces dimensioned, configured and disposed for cooperation with the armature, a magnetic circuit including at least one coil, a plurality of iron shunt lamina spanning the magnetic circuit intermediate at least the one coil and the first and second pole pieces, and a plurality of copper washer slugs in the magnetic circuit intermediate at least one of the first and second pole pieces and the iron shunt lamina.

The invention also includes apparatus which may include a magnetic return strip spanning the magnetic circuit proximate to the first and second pole pieces and intermediate at least one of the pole pieces and one of the copper washer slugs. The magnetic circuit includes a core extending through at least the one coil and the iron shunt lamina each having first and second holes therein dimensioned and configured for cooperation with the core. The copper washer slugs may each include a central bore and the bore is dimensioned and configured for engagement with the core. The iron shunt lamina may have a thickness of about 0.014 inches thick.

The invention also includes the method of immunizing a relay from alternating current in the circuit coupled to the operating coil thereof which comprises providing the combination of a laminated iron shunt spanning a magnetic circuit coupling first and second pole piece of a relay and a plurality of copper washer slugs disposed in the magnetic circuit proximate to one of the pole pieces.

BRIEF DESCRIPTION OF THE DRAWING

The invention will be better understood by reference to the accompanying drawing in which.

DESCRIPTION OF THE PREFERRED EMBODIMENT

Figure 4:
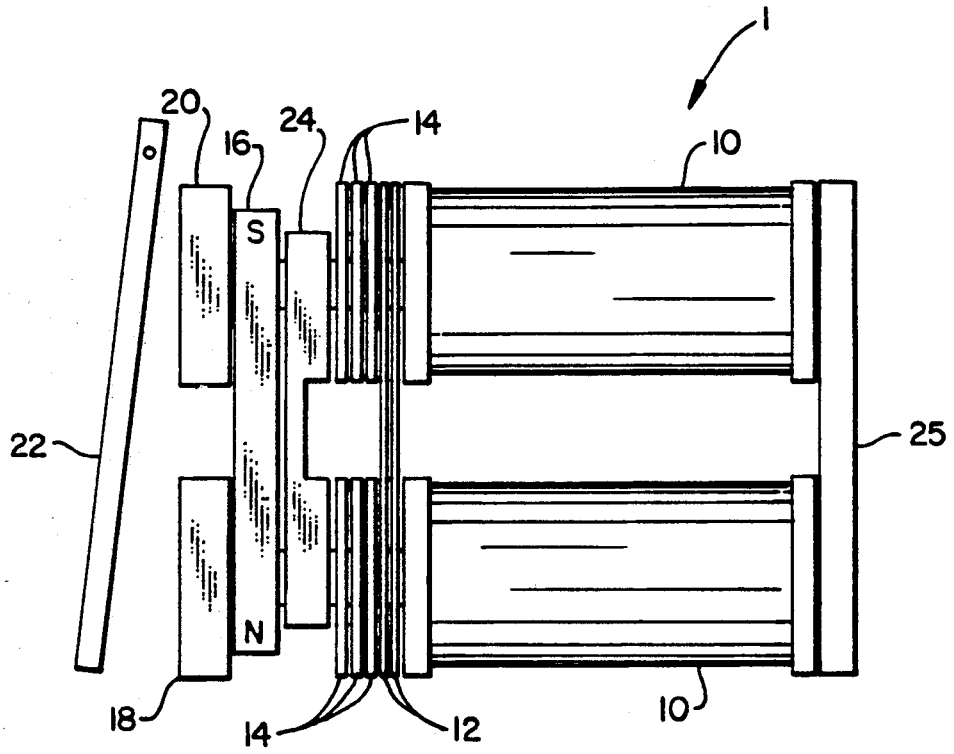
FIG. 4 is a schematic view of the relay in accordance with the present invention.

Referring now to FIG. 4 there is shown a simplified schematic of part of a bias neutral B relay structure 1. To evaluate alternative constructions, an existing B relay structure without relay contact blocks (not shown) and a single short low resistance coil 10 was used to try out some immunizing techniques. The coil 10 had a resistance of 0.07 ohms. The relay was a biased neutral B relay structure although, when experimenting with this structure as a neutral relay, the magnet 16 and the leakage strip 25 were removed so that comparable performance measurements could be made on the same relay structure as when it was configured as a bias neutral relay. The structure is shown in FIG. 4 includes two coils 10, 10 iron shunt lamina 12, 12, 12 and copper washer slugs 14, 14, 14. The structure further includes a magnet 16, pole pieces 18, 20 and an armature 22 that cooperates with the pole pieces 18, 20. The magnetic path is completed by a yoke 24.

Figure 8:
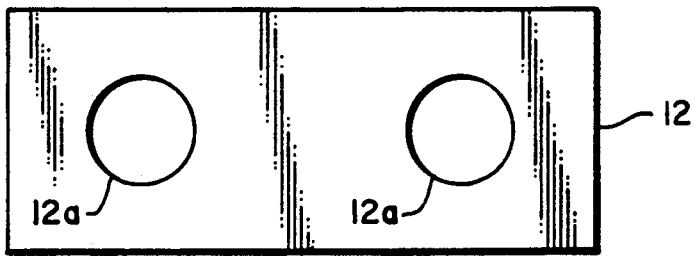
FIG. 8 is a plan view of an individual shunt lamina used in the relay in accordance with one form of the invention.

The copper washer slugs 14, 14, 14 may have various dimensions without departing from the spirit of the invention. In the preferred embodiment they are 1⅝ inches in diameter and have a height between 1/16 to ⅛ inch. It will be understood that the total height of the stack of copper washer slugs 14, 14, 14 is of greater significance than the number of copper washer slugs 14 that are used to achieve that height. In the preferred embodiment the iron shunt lamina 12 is manufactured of transformer lamina 12 cut to the shape shown in FIG. 8. In the preferred embodiment the lamina 12 has a thickness of 0.014 inches (29 gage). Other thicknesses may be used in other embodiments of the invention. Each lamina 12 is three inches by 1¼ inches and has two holes **12*a*** therein which are each 37/64 inches in diameter disposed therein. These holes are dimensioned for engagement with the structure of the relay.

Figure 1:
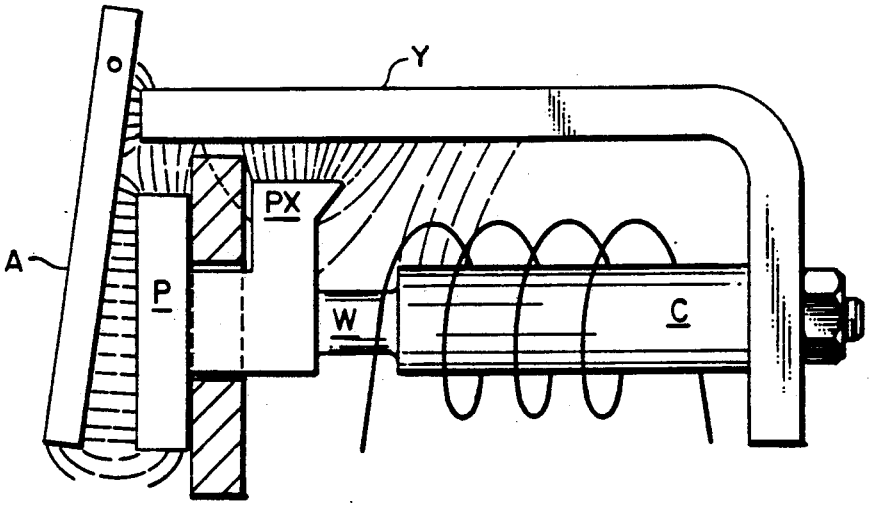
FIG. 1 PRIOR ART
FIG. 1 is a schematic view of a prior art alternating current immunized relay.
Figure 2:
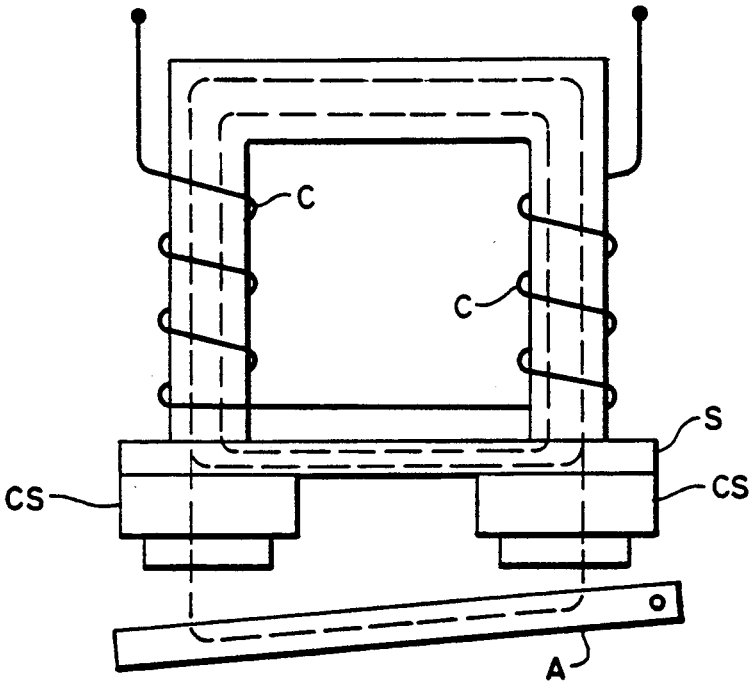
FIG. 2 PRIOR ART
FIG. 2 is a schematic view of another prior art alternating current immunized relay.
Figure 3:
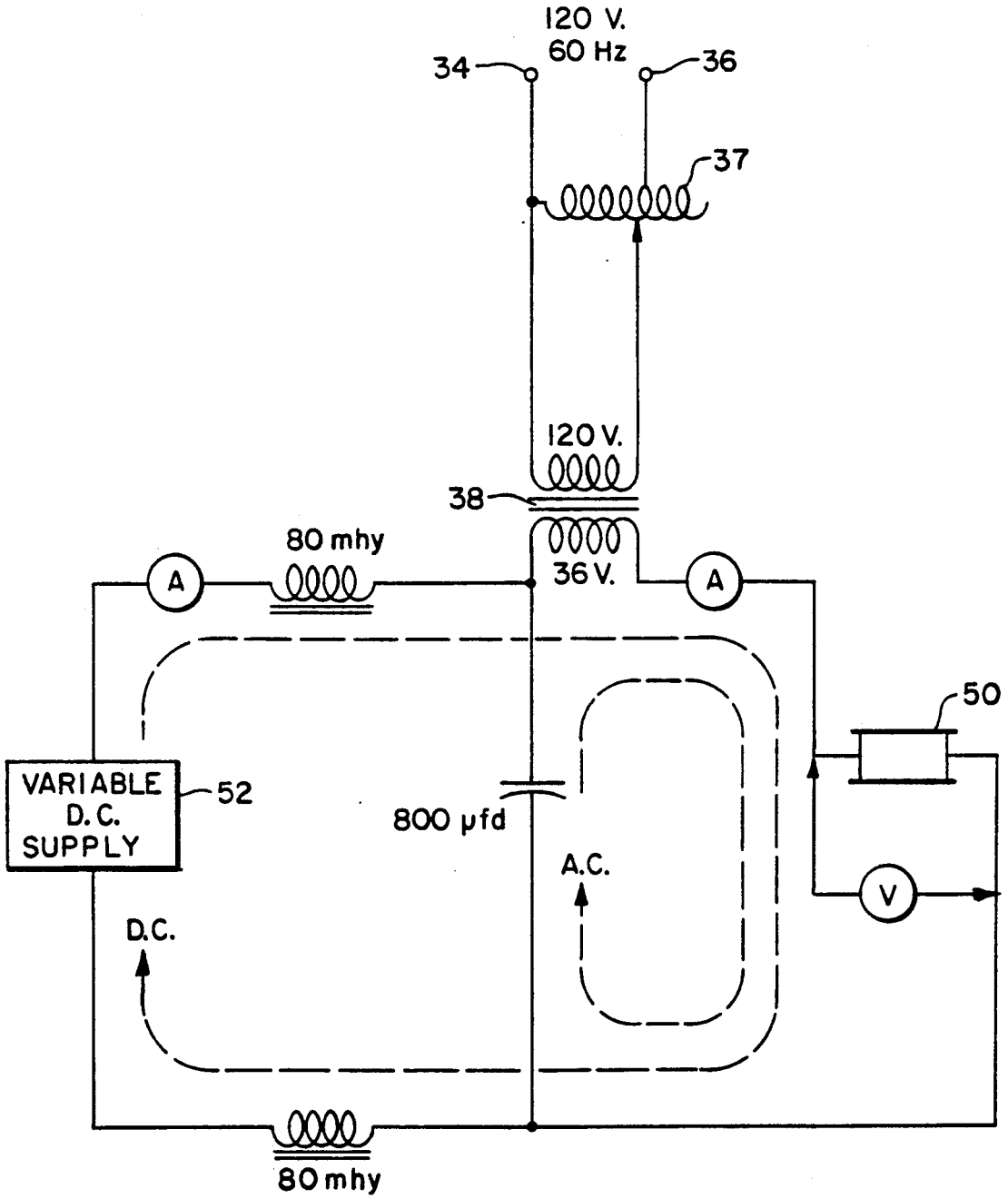
FIG. 3 is a schematic view illustrating the manner of testing to evaluate the effects of alternating current on various relay constructions.

The evaluation was conducted using the test circuit shown in FIG. 3 which included a 120 volt 60 hertz source connected between terminals 34, 36 coupled by a variac 37 to a transformer 38. The secondary of the transformer 38 was connected in series with the relay 50 under test. A variable direct current supply 52 was coupled in a loop which was partially coextensive with the loop in which the alternating current flowed. Thus, the relay 50 under test was subjected to both alternating current and direct current simultaneously.

Figure 5:
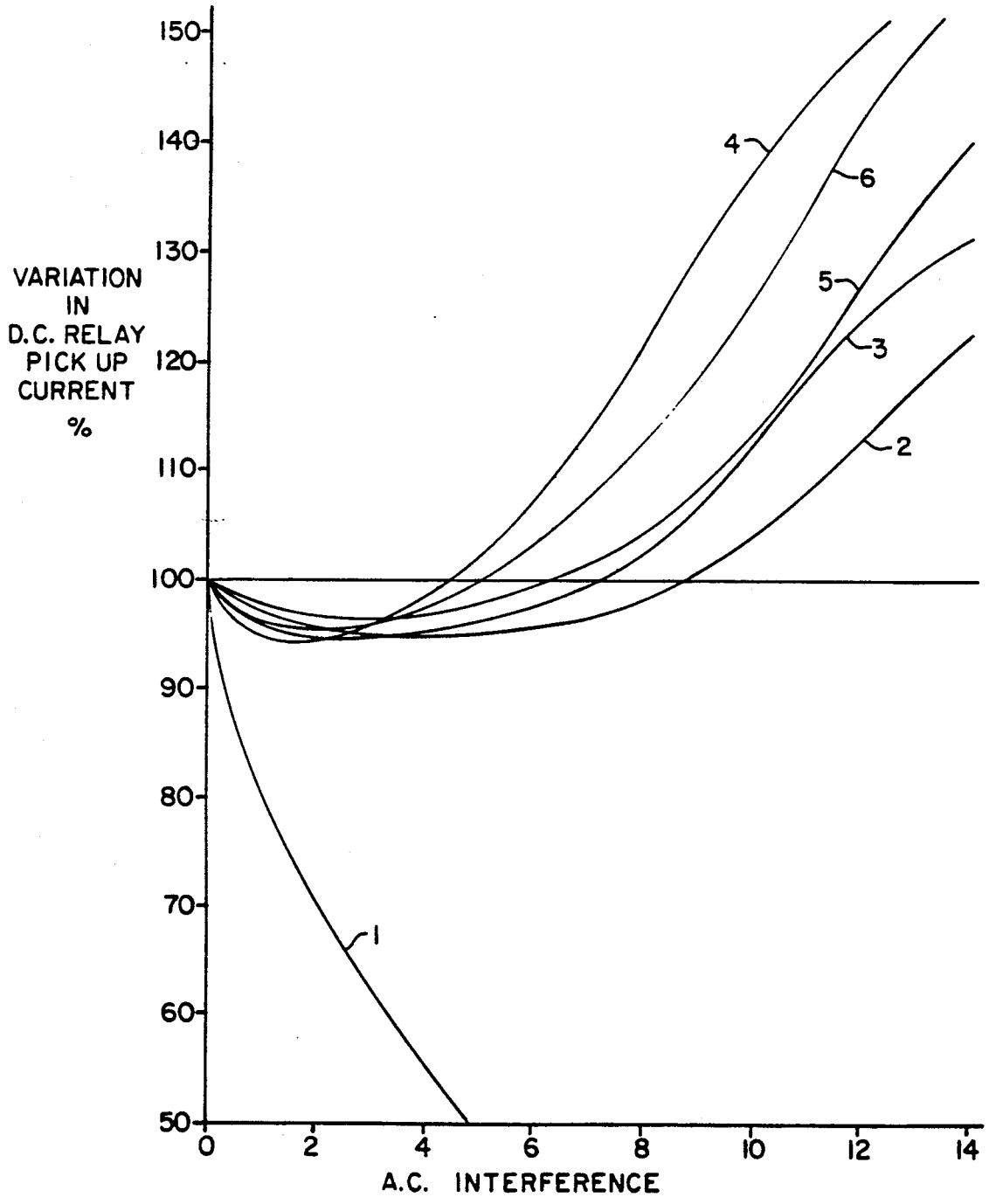
FIG. 5 is a diagrammatic illustration showing the relationship between the variation and direct current relay pick up current versus alternating current interference.
Figure 6:
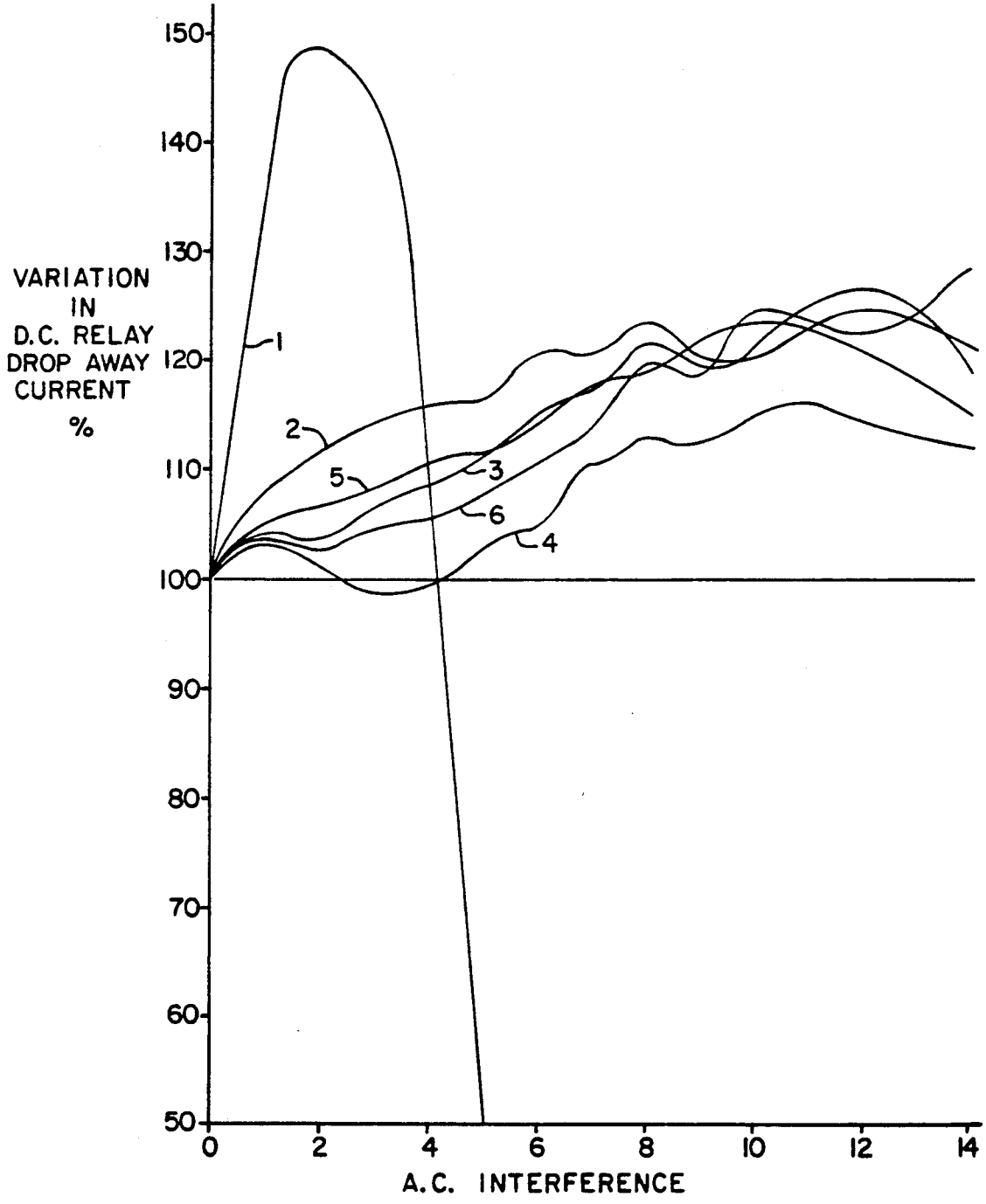
FIG. 6 is a diagrammatic illustrations showing the relationship between the variation and direct current drop away current versus alternating current interference.

The results of these tests on an un-immunized relay as well as with different immunized configurations are shown in FIGS. 5 and 6. These tests were made with no contact blocks on the relay, to simplify the disassembly and reassembly of the relay into the different configurations shown. While the relay required for the Broken Rail Detection System needs to be a bias neutral relay, testing was also conducted with the test relay structure configured as a neutral relay to provide additional information purposes.

Figure 7:
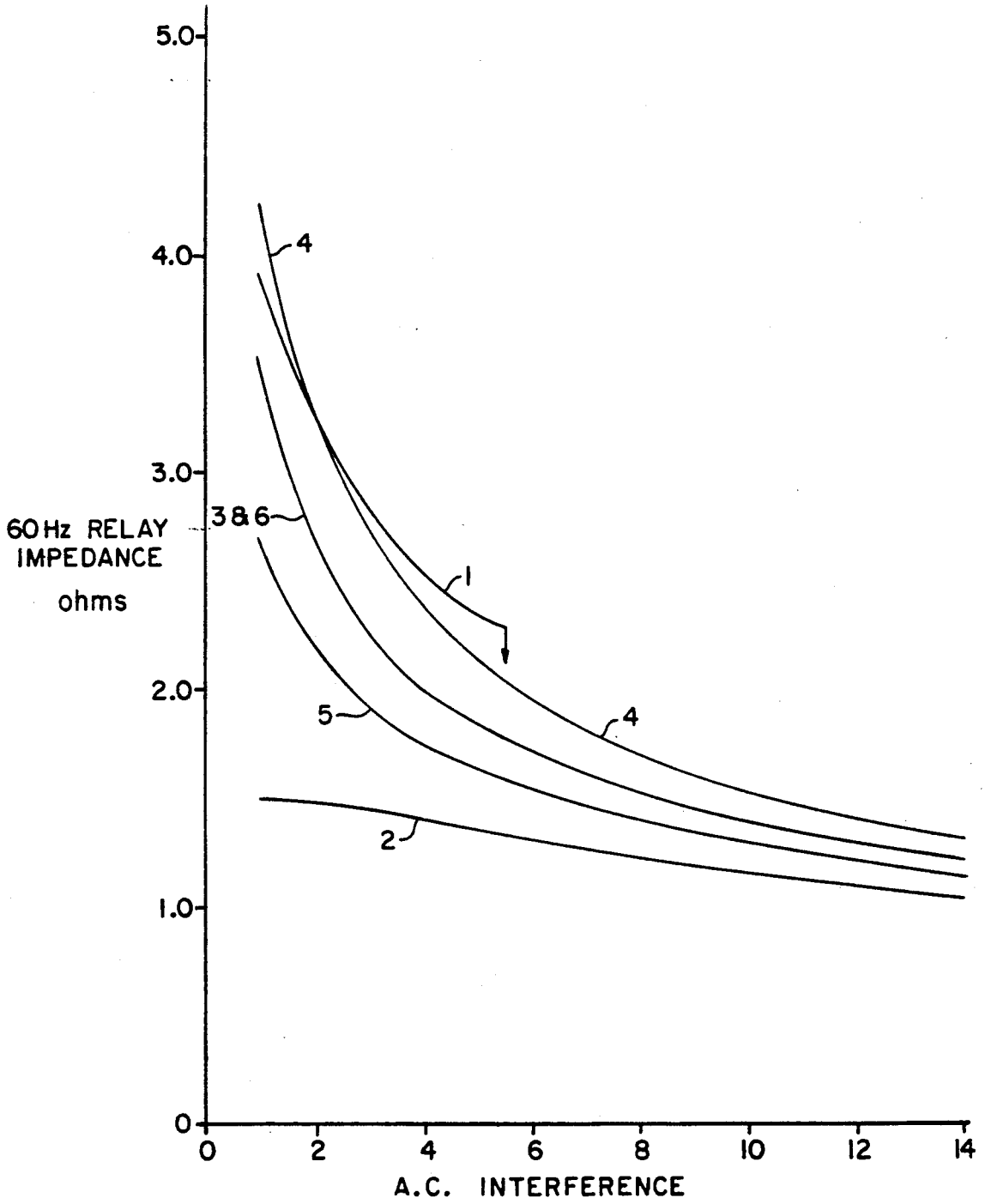
FIG. 7 is a diagrammatic view illustrating the relationship between the 60 hertz relay impedance and ohms versus current.

FIG. 5 shows the variation in the direct current relay pick up current versus alternating current interference. FIG. 6 shows the variation in direct current relay drop away current versus alternating current interference for the same six relay configurations. Similarly, FIG. 7 illustrates the 60 hertz relay impedance in ohms for a biased neutral B1 relay structure having two coils in parallel which have a combined resistance of 0.07 ohms. In FIGS. 5, 6 and 7 the curves are each numbered 1 through 6 and the same number refers to the same configuration in each of these figures. Number 1 refers to the normal non-immunized configuration with no slugs 14 or lamina 12. Number 2 refers to the configuration with 5 slug washers 14 on each core and no lamina 12. Number 3 refers to a 4 slug washer 14 on each core with 2 shunt lamina 12. Number 4 refers to a 4 slug washer 14 on each core with 4 shunt lamina 12. Number 5 refers to a 5 slug washer 14 on each core configuration with 1 shunt lamina 12. Number 6 refers to a 5 slug washer 14 on each core configuration with 2 shunt lamina 12.

It can be seen that both the use of the copper slug washers 14 and the magnetic shunt lamina 12 aid in immunizing the relay against pick-up by alternating current. While the copper slug washers 14 do not appear to affect the pick-up and drop-away operating current levels, they produced a noticeable change in relay operating times. The shunt lamina 12 do not affect the operating times of the relay, but do decrease the sensitivity of the relay. This effect is more pronounced for the neutral relay than for the bias neutral relay configuration. This may be due to the fact that the magnetic alternating current shunt lamina 12 by-passes some of the magnetic operating flux from the neutral relay structure, while for the bias neutral relay structure, the magnetic alternating current shunt lamina 12 just changes the reluctance of the by-passing flux path of the permanent magnet 16 in the relay. Using just the copper washer slugs 14 without the lamina 12 lowers the 60 hertz impedance of the relay below that of the unmodified relay, since these copper washer slugs 14 act as shorted secondary turns to the alternating current signal in the relay coils 10, 10. The copper washer slugs 14 alone will increase the immunity of the relay to alternating current, without the shunt lamina 12, the resulting decrease in coil impedance allows a greater flow of alternating current through the relay coil, which detracts from some of its potential alternating current immunity. By adding the shunt lamina 12, the shorted turn effect of the copper washer slugs 14 is decoupled from the relay coils 10, 10 and the relay coil exhibits a 60 hertz impedance similar to the unmodified relay.

In the unmodified relay, the direct current operating characteristics of the relay were found to change as the level of alternating current interference increased. Particularly, the direct current sensitivity of the relay to pick-up would increase as the level of the alternating current interfering signal increased. This is an undesirable, unsafe operating characteristic and was a characteristic of the unmodified relay. Surprisingly, the relay with the immunization modification in accordance with the invention only increased its pick-up sensitivity by about 5% maximum as the alternating current interfering signal level was initially increased. The pick-up sensitivity decreased as the alternating current interfering signal level was further increased.

A particularly desirable configuration for the immunized bias neutral relay for the broken rail detection system has four copper washer slugs 14 and two pieces of lamina 12. This provides fast relay operation with a minimum reduction of relay sensitivity, a moderately high alternating current coil impedance and sufficient alternating current immunity. The combination of copper washer slugs 14 and lamina 12 described above is particularly advantageous for modifying existing relays, since it requires only the lamina 12 as a new part. It will be understood that the prior art utilized the copper washer slugs 14 to change the timing characteristics of the relay. No known intentional use was made of such copper washer slugs 14 to provide alternating current immunization.

The copper washer slugs 14 provide a high reluctance for the alternating current and don't provide a high reluctance for the direct current flux. The direct current flux will continue to flow and to operate the relay the way it did without the alternating current.

The iron lamina 12 is a much more efficient magnetic path for alternating current than the known monolithic heavy solid metal shunt. By going to the lamina 12, a much more efficient material for alternating current flux shunting is provided. This arrangement gives us a much finer control in adjustment because we can add as many of these as we want. We add one at a time and it just makes a small change each time to get the characteristics we want. With a heavy monolithic shunt you have to calculate in advance and if it isn't right, then you have to rebuild the unit. The lamina 12 is a much more efficient magnetic path for alternating current than a solid iron shunt.

As the coil resistance is changed, the number of lamina 12 and the number of slugs 14 are also changed. Also the requirement for varying number of copper washer slugs 14 and lamina 12 depends on what you are doing with the relay. In some cases you might want a fast acting relay and then, you'd have to use fewer slugs 14. The slugs 14 tend to slow the relay down. The lamina 12 doesn't change the timing of the relay at all and you can get the same immunity with fewer slugs 14 and more lamina 12. Unfortunately, the lamina 12 desensitizes the relay. And so, if you are up against the limit of sensitivity, then you don't wish to desensitize the relay any more, and that becomes critical and then you would use more copper slugs 14 and less lamina 12. It depends on each application as to what things are most important and so you can very easily balance the effect that you want. So the big advantage is that you can balance various effects and you could make many relays with the same parts whereas before they used solid iron instead of the slugs 14 and the lamina 12.

It will thus be seen that the relay in accordance with the present invention provides substantial immunity to induced alternating current voltages and will promote safe railroad operation. It will further be seen that the relay used for a broken rail detection circuit must have a low resistance and that the present invention does not compromise that low resistance characteristic of the relay. The invention is also highly desirable in that the various trade-offs may be made in small increments due to the use of discrete lamina 12 and discrete copper washer slugs 14 to achieve the desired physical characteristics of the relay.

The invention has been described with reference to its illustrated preferred embodiment. Persons skilled in the art of alternating current immunized relays may upon exposure to the teachings herein, conceive other variations. Such variations are deemed to be encompassed by the disclosure, the invention being delimited only by the appended claims.

Having thus described my invention I claim:

1. A relay apparatus which comprises:

an armature;

means for pivotally mounting said armature;

first and second pole pieces dimensioned, configured and disposed for cooperation with said armature;

a magnetic circuit including at least one coil;

a plurality of iron shunt lamina spanning said magnetic circuit intermediate at least said one coil and said first and second pole pieces; and a plurality of copper washer slugs in said magnetic circuit intermediate at least one of said first and second pole pieces and said iron shunt lamina.

2. The apparatus as described in claim 1 further including:

a magnet and a return strip spanning said magnetic circuit proximate to said first and second pole pieces and intermediate at least one of said pole pieces and one of said copper washer slugs.

3. The apparatus as described in claim 2 wherein:

said magnetic circuit includes a core extending through at least said one coil, said iron shunt lamina each having first and second holes therein dimensioned and configured for cooperation with said core.

4. The apparatus as described in claim 3 wherein:

said copper washer slugs each include a central bore and said bore is dimensioned and configured for engagement with said core.

5. The apparatus as described in claim 4 wherein:

said iron shunt lamina has a thickness of about 0.014 inches thick.

6. The method of immunizing a relay from alternating current in the circuit coupled to the holding coil thereof which comprises:

providing the combination of a laminated iron shunt spanning a magnetic circuit coupling first and second pole piece of a relay and a plurality of copper washer slugs disposed in the magnetic circuit proximate to one of said pole pieces.

7. The method of immunizing a relay from alternating current as described in claim 6 further including:

the step of varying the effective reluctance of said relay by varying the number of iron shunt lamina.

* * * * *